US006994398B2

(12) United States Patent
Gross

(10) Patent No.: US 6,994,398 B2
(45) Date of Patent: Feb. 7, 2006

(54) SEATING BRACKET

(75) Inventor: John Gross, Vancouver (CA)

(73) Assignee: Peak Innovations Inc., Richmond (CA)

( * ) Notice: Subject to any disclaimer, the term of this patent is extended or adjusted under 35 U.S.C. 154(b) by 0 days.

(21) Appl. No.: 10/809,390

(22) Filed: Mar. 26, 2004

(65) Prior Publication Data

US 2004/0189064 A1 Sep. 30, 2004

(51) Int. Cl.

| | |
|---|---|
| ***A47C 31/00*** | (2006.01) |
| ***A47C 15/00*** | (2006.01) |
| ***A47C 5/12*** | (2006.01) |
| ***E04H 3/12*** | (2006.01) |

(52) U.S. Cl. ..... 297/217.7; 297/451.1; 297/232; 52/8

(58) Field of Classification Search ..... 297/452.18, 297/217.7, 451.1, 455.1, 446.2, 232; 248/501; 52/634, 636, 695, 8

See application file for complete search history.

(56) References Cited

U.S. PATENT DOCUMENTS

| | | | | |
|---|---|---|---|---|
| 855,817 | A * | 6/1907 | Schoenecke | 297/452.2 |
| 897,371 | A | 9/1908 | Huebner | |
| 1,618,803 | A | 2/1927 | Bokan | |
| 1,799,337 | A * | 4/1931 | Warhus | 52/634 |
| 2,025,088 | A | 12/1935 | Boller | |
| 2,095,625 | A | 10/1937 | Allen | |
| 2,171,374 | A | 8/1939 | Ryan et al. | |
| 2,177,277 | A * | 10/1939 | Burke | 52/634 |
| 3,584,916 | A | 6/1971 | Bayes | |
| 4,285,542 | A | 8/1981 | Boisvert | |
| D266,133 | S | 9/1982 | Stahl, Jr. et al. | |
| 4,918,880 | A | 4/1990 | Carney | |
| D312,543 | S | 12/1990 | Shields | |
| D331,343 | S | 12/1992 | VanStaveren | |
| D348,216 | S | 6/1994 | Smith | |
| 5,337,471 | A * | 8/1994 | Graney | 29/432 |
| 5,382,083 | A * | 1/1995 | Fecteau et al. | 297/452.2 |
| D461,708 | S | 8/2002 | Viger | |

FOREIGN PATENT DOCUMENTS

| | | |
|---|---|---|
| CA | 27346 | 2/1965 |
| CA | 48231 | 5/1981 |

(Continued)

OTHER PUBLICATIONS

Copy of a webpage from http:///www.dekmate.com dated Jan. 14, 2002.

Copy of a webpage from http://www.deckzone.net/bench.php date Sep. 6, 2003.

*Primary Examiner*—Peter M. Cuomo
*Assistant Examiner*—Sarah C. Bumham

(57) ABSTRACT

A seating bracket for connection to a base having a top surface and a vertical side surface to support a seat and a back joist adjacent to the seat. The bracket may include a generally horizontal top portion for supporting the seat and a generally horizontal bottom portion for connection to the top surface of the base. First and second generally vertical side portions may extend between and be connected to the top and bottom portions and may support the top portion above the bottom portion. First and second intersecting cross members may extend between and be connected to the top portion and to the first and second generally vertical side portions. Upper and lower back joist support portions may be connected to the first generally vertical side portion adjacent for receiving the back joist and holding the back joist in a generally upstanding position. The lower back joist support portion may include a downwardly extending portion below the bottom portion for connection with the vertical side surface of the base.

7 Claims, 3 Drawing Sheets

FOREIGN PATENT DOCUMENTS

| | | |
|---|---|---|
| CA | 67312 | 10/1990 |
| CA | 72449 | 4/1993 |
| CA | 82885 | 1/1998 |
| CA | 94389 | 1/2002 |

* cited by examiner

SEATING BRACKET

FIELD OF THE INVENTION

The invention relates to the field of seating devices and in particular to a bracket for supporting a seat and back joist of a bench-type deck seat.

BACKGROUND OF THE INVENTION

Bench-type seats are widely used in many different forms. Depending upon their use, bench-type seats are fabricated from a wide variety of materials and in many different configurations.

The following U.S. patents show examples of different forms of bench-type seats: Schoenbecke, U.S. Pat. No. 855,817; Huebner, U.S. Pat. No. 897,371; Bokan, U.S. Pat. No. 1,618,803; Boller, U.S. Pat. No. 2,025,088; Allen, U.S. Pat. No. 2,095,625; Ryan et al, U.S. Pat. No. 2,171,374; Bayes, U.S. Pat. No. 3,584,916; and Boisvert, U.S. Pat. No. 4,285,542.

There is a continuing need for inexpensive, simple-to-construct, sturdy, yet attractive bench-type seats which can be used in conjunction with decks, patios, benches, and the like. The construction of the bench-type seats should be as simple as possible, so that they can be simply assembled by any do-it-yourselfer.

SUMMARY OF THE INVENTION

According to one aspect of the present invention there is provided a seating bracket for connection to a base having a top surface and a vertical side surface to support a seat and a back joist adjacent to the seat. The bracket may include a generally horizontal top portion for supporting the seat and a generally horizontal bottom portion for connection to the top surface of the base. First and second generally vertical side portions may extend between and be connected to the top and bottom portions and may support the top portion above the bottom portion. First and second intersecting cross members may extend between and be connected to the top portion and to the first and second generally vertical side portions. Upper and lower back joist support portions may be connected to the first generally vertical side portion adjacent for receiving the back joist and holding the back joist in a generally upstanding position. The lower back joist support portion may include a downwardly extending portion below the bottom portion for connection with the vertical side surface of the base.

The generally horizontal top portion may include a hole therein for permitting connectors to connect the seat to the top portion. The generally horizontal bottom portion may include a hole therein for permitting connectors to connect the bottom portion to the top surface of the base. The upper and lower back joist support portions may each include a hole for permitting connectors to connect the support portions to the back joist.

The first generally vertical side portion may be inclined with respect to vertical. The upper and lower back joist support portions may hold the generally upstanding back joist substantially parallel to the first generally vertical side portion.

In another aspect of the present invention there is provided a seating bracket for connection to a base having a top surface and a vertical side surface to support a seat and a generally upstanding back joist adjacent to the seat. The bracket may include a quadrangular portion having a top portion for supporting the seat, a bottom portion for connection to the top surface of the base, and first and second sides extending between the top and the bottom portions, the first side being inclined with respect to vertical. First and second intersecting cross members may extend between and be connected to the quadrangular portion.

The lower back joist support portion may have a downwardly extending portion below the bottom portion for connection with the vertical side surface of the base. The upper and lower back joist support portions may hold the back joist substantially parallel to the first side portion. The quadrangular portion, and first and second intersecting cross members may be a unitary structure.

In yet another aspect of the present invention there is provided a deck seat for connection to a deck floor having a top surface and a vertical side surface. The deck seat may include a plurality of brackets connected to the deck floor at spaced positions.

Each bracket may include a quadrangular portion having a top portion for supporting the seat, a bottom portion for connection to the top surface of the deck floor, and first and second sides extending between and connected to the top and the bottom portions, the first side being inclined with respect to vertical. Each bracket may also include first and second intersecting cross members extending between and connected to the quadrangular portion. Upper and lower back joist support portions may be connected to the first side portion for receiving the back joist and holding the back joist substantially parallel to the first side portion. Seat planks may extend between each bracket and be supported on the top portions of the quadrangular portions of each bracket. A plurality of back joists proximate the seat planks may extend through the upper and lower back joist support portions and may be supported at its bottom end by a downwardly extending portion below the bottom portion. Back supports may be connected to and extend between the back joists at a position above the brackets.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
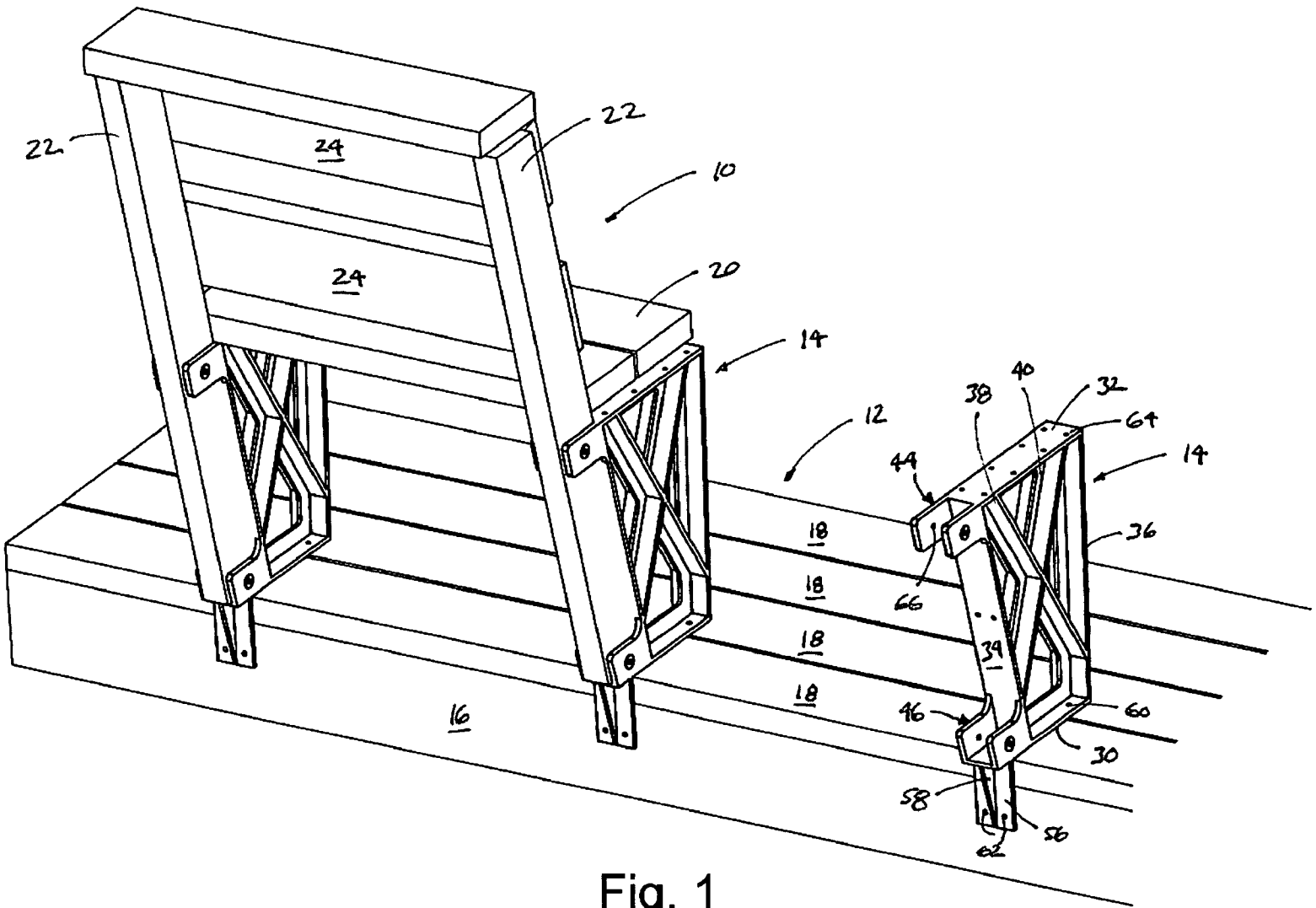
FIG. 1 is a perspective view showing a section of bench-type seat connected to an outdoor deck using a seating bracket of the present invention.
Figure 2:
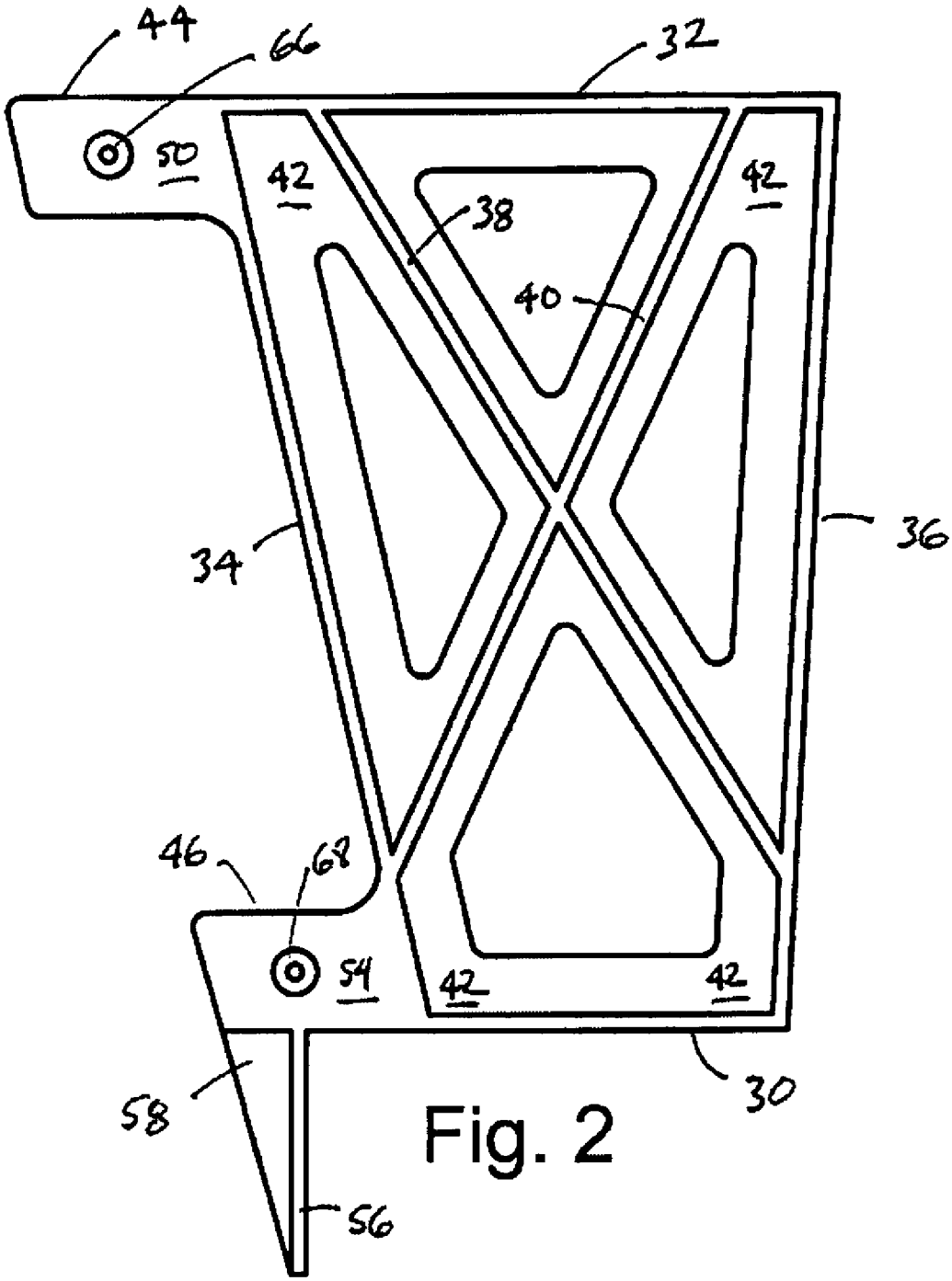
FIG. 2 is a front view of the seating bracket of FIG. 1 wherein the front and rear views are the same.
Figure 3:
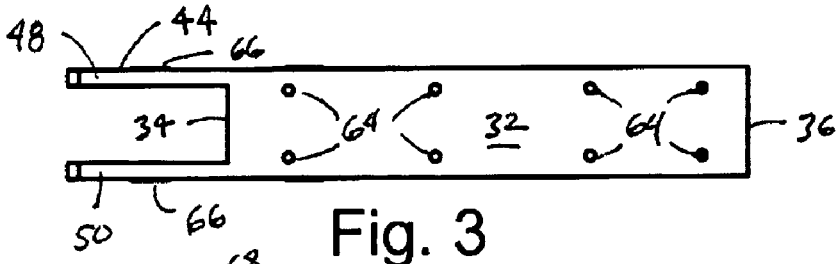
FIG. 3 is a top view of the seating bracket of FIG. 1.
Figure 4:
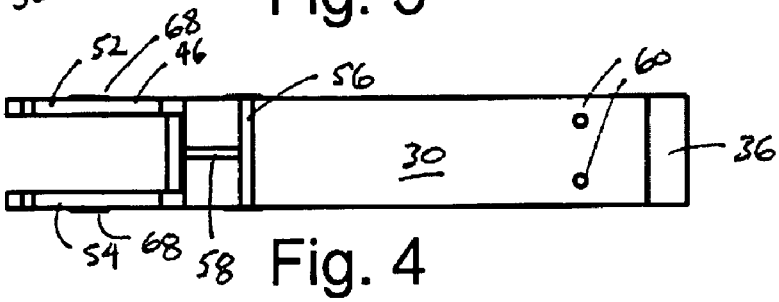
FIG. 4 is a bottom view of the seating bracket of FIG. 1.
Figure 5:
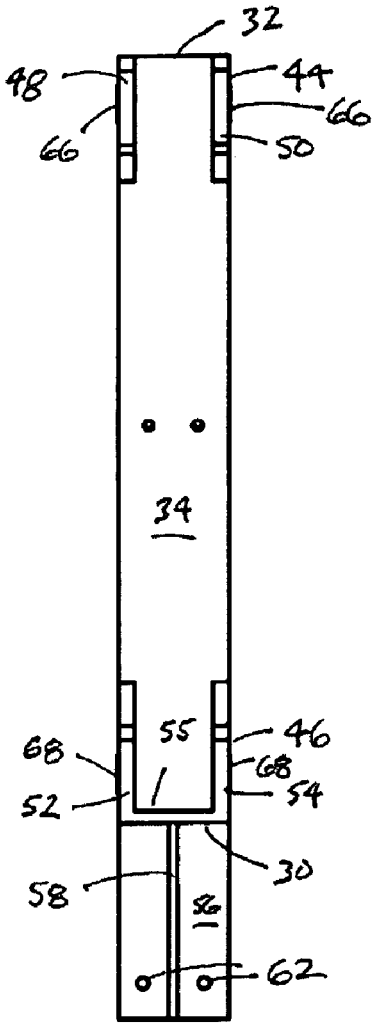
FIG. 5 is a left-hand side view of the seating bracket of FIG. 1.
Figure 6:
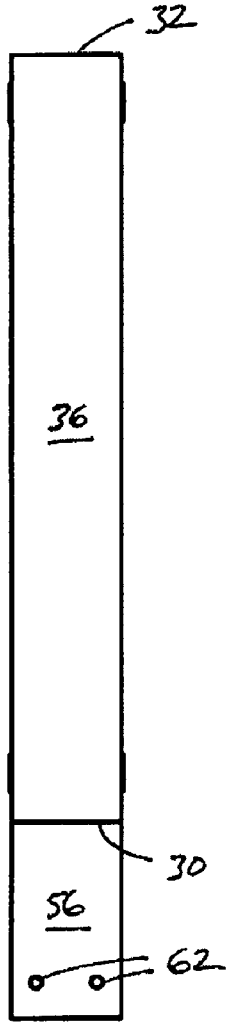
FIG. 6 is a right-hand side view of the seating bracket of FIG. 1.

FIG. 1 shows a bench-type deck seat 10 which utilizes the present invention. As shown in FIG. 1, deck seat 10 is supported above deck 12 by brackets 14, which are located at spaced positions around the periphery of deck 12. For ease of illustration, only two brackets 14 support deck seat 10, although deck seat 10 may comprise a number of other brackets spaced around the periphery of deck 12.

Deck 12 is formed by deck joists 16, which are, for example, 2×10 or 2×12 joists set on edge. Deck planks 18 are arranged horizontally to form the top surface of deck 12. Deck planks 18 may be, for example, 2×8 or 2×10, planks arranged side-by-side across the deck to form the top surface of deck 12.

Bench-type seats 10 include seat planks 20, which are attached to the top of brackets 14 and which extend between at least two of the spaced brackets. Seat planks 20 may be, for example, 2×6 or 2×8 planks which are supported on the top of brackets 14.

The back portions of seats 10 include back joists 22, which are held by brackets 14 and which extend generally upwardly. As shown in FIG. 1, back joists 22 are slightly inclined with respect to vertical and support back support planks 24, which are attached and extend between the upstanding back joists 22. In one preferred embodiment, back joists 22 are 2×4 planks.

FIGS. 2, 3, 4, 5 and 6 show the seating bracket of the present invention in greater detail. Bracket 14 is a bracket having a quadrangular portion formed by bottom 30, top 32, and first and second sides 34 and 36. Bottom 30 and top 32 are essentially parallel and are generally horizontal when bracket 14 is attached to deck 12. First side 34 is slightly inclined with respect to vertical at an angle which defines the angle of inclination of back joists 22. Second side 36, is generally vertical, but may be slightly inclined with respect to vertical as illustrated.

To provide rigidity and strength, bracket 14 includes first and second intersecting cross members 38 and 40 extending between and connected to the quadrangular portion. In the preferred embodiment, webbing 42 is connected to cross members 38 and 40 to provide additional rigidity and strength to bracket 14.

An upper back joist support portion 44 is connected to the first side 34 adjacent to the top 32 and a lower back joist support portion 46 is connected to the first side adjacent the bottom 30. Upper support portion 44 includes tabs 48 and 50 connected to the first side 34. Similarly, lower support portion 46 includes tabs 52 and 54 connected to the first side 34. To provide a platform for back joists 22 to rest upon, lower support portion 46 further includes a base 55 connected to the first side 34 and between tabs 52 and 54. Tabs 48, 50, 52 and 54 are horizontally spaced apart to accommodate back joists 22. Tabs 48, 50, 52 and 54 and base 55 are dimensioned to received back joists 22.

A downwardly extending portion 56 extends from the lower support portion 46 below the bottom 30 for connection to deck joists 16 to further secure the bracket 14 to the deck 10. To provide rigidity and strength to the downwardly extending portion 56, a spine 58 is connected thereto.

Operation

Various connecting means, such as fasteners, nails and adhesives may be used to attach bracket 14 to deck 12, and connect seat plank 20 and back joist 22 to bracket 14. Holes 60 in bottom 30 of the bracket permits fasteners (not illustrated) to connect bracket 14 to the top surface of deck plank 18. Fasteners through holes 62 connect downwardly extending portion 56 to the side surface of the deck joists 16. Seat plank 20 is attached to bracket 14 by fasteners which extend through holes 64 in top portion 32 of bracket 14.

Fasteners extend through holes 66 in tabs 48 and 50 of upper back joist support portion 44 to connect back joist 22 to the first side 34. Fasteners also extend through holes 68 in tabs 52 and 54 of lower back joist support portion 46 to also connect back joist 22 to the first side 34. Back joist 22 may have its bottom surface cut at an angle so that the bottom surface rests essentially flat and in contact with base 55 of lower support portion 46.

It can be seen that the bracket of the present invention is low cost and easy to fabricate and may be fabricated from a unitary structure out of plastic, metal or other rigid material.

As illustrated in FIG. 1, the use of the bracket 14 of the present invention yields a deck seat around the edge of the deck which can replace the conventional deck railing. Bench-type seats 10 provide a large amount of seating around the deck, while also acting as a guard rail.

Although the embodiment specifically shown in FIG. 1 is a deck 12 to which the bench-type seats are attached, the present invention may also be used in conjunction with benches or other structures. All that is required is that bracket 14 be attached to a suitable base.

Although the present invention has been described with reference to preferred embodiments, workers skilled in the art will recognize that changes may be made in form and detail without departing from the spirit and scope of the invention.

What is claimed is:

1. A seating bracket for connection to a base having a top surface and a vertical side surface to support a seat and a back joist adjacent to the seat, the bracket comprising:

a generally horizontal top portion for supporting the seat;

a generally horizontal bottom portion for connection to the top surface of the base;

first and second side portions extending between and connected to said top and bottom portions and supporting said top portion above said bottom portion;

first and second intersecting cross members extending between and connected to said top portion and said first and second side portions;

an upper back joist support portion connected to said first side portion adjacent to said top portion a lower back joist support portion connected to said first side portion adjacent to said bottom portion, said lower back joist support portion comprising a pair of spaced tabs, a base surface extending therebetween, and a downwardly extending portion extending from and below said base surface, said base surface extending perpendicular to said first side portion, and said downwardly extending portion being perpendicular to said bottom portion laterally offset from said first side portion and adapted for connection with said vertical side surface of the base; and wherein said lower back joist support portion being adapted for receiving a back joist and, in conjunction with said upper back joist support portion, holding the back joist in a generally upstanding position.

2. The seating bracket of claim 1 wherein said generally horizontal top portion includes a hole therein for permitting connecting means to connect the seat to said top portion, said generally horizontal bottom portion includes a hole therein for permitting connecting means to connect said bottom portion to said top surface of the base, and wherein said upper and lower back joist support portions each include a hole for permitting connecting means to connect said support portions to the back joist.

3. The seating bracket of claim 1 wherein the first side portion is inclined with respect to vertical and wherein the upper and lower back joist support portions are adapted to hold the back joist substantially parallel to said first side portion.

4. A seating bracket for connection to a base having a top surface and a vertical side surface to support a seat and a generally upstanding back joist adjacent to the seat, the bracket comprising:

a quadrangular portion having a top portion for supporting the seat, a bottom portion for connection to the top surface of the base, and first and second sides extending between said top and said bottom portions, said first side being inclined with respect to vertical;

first and second intersecting cross members, said cross members being integrally formed and extending between and connected to said top portion and said sides of said quadrangular portion;

an upper back joist support portion connected to said first side portion adjacent to said top portion; and a lower back joist support portion connected to said first side portion adjacent to said bottom portion, said lower back joist support portion comprising a pair of spaced tabs, a base surface extending therebetween, and a downwardly extending portion extending from and below said base surface, said base surface extending perpendicular to said first side portion, and said downwardly extending portion being perpendicular to said bottom portion laterally offset from said first side portion and adapted for connection with said vertical side surface of the base; and wherein said lower back joist support portion being adapted for receiving a back joist and, in conjunction with said upper back joist support portion, holding the back joist in a generally upstanding positions.

5. The seating bracket of claim 4 wherein said upper and lower back joist support portions are adapted to hold the back joist substantially parallel to said first side portion.

6. The seating bracket of claim 4 wherein said quadrangular portion, first and second intersecting cross members, upper and lower back joist support portion and downwardly extending portion are a unitary structure.

7. A deck seat for connection to a deck floor having a top surface and a vertical side surface, the deck seat comprising:

a plurality of brackets connected to the deck floor at spaced positions, each bracket comprising:

a quadrangular portion having a top portion for supporting the seat, a bottom portion for connection to the top surface of the deck floor, and first and second sides extending between and connected to said top and said bottom portions, said first side being inclined with respect to vertical;

first and second intersecting cross members, said cross members being integrally formed and extending between and connected to said top portion and said sides of said quadrangular portion;

an upper back joist support portion connected to said first side portion adjacent to said top portion;

a lower back joist support portion connected to said first side portion adjacent to said bottom portion, said lower back joist support portion comprising a pair of spaced tabs, a base surface extending therebetween, and a downwardly extending portion extending from and below said base surface, said base surface extending perpendicular to said first side portion, and said downwardly extending portion being perpendicular to said bottom portion laterally offset from said first side portion and adapted for connection with said vertical side surface of the base; and wherein said lower back joist support portion being adapted for receiving a back joist and, in conjunction with said upper back joist support portion, holding the back joist substantially parallel and in abutment to the first side portion;

a seat supported on said top portion of each bracket and extending therebetween;

a plurality of back joists, each one of said plurality of back joists being connected to a respective one of said plurality of brackets by way of said upper and lower back joist support portions; and back support means connected to and extending between said back joists at a position above said brackets.

* * * * *